United States Patent [19]

Reynolds

[11] 4,261,247

[45] Apr. 14, 1981

[54] DOUBLE ACTION CHARGING MECHANISM

[75] Inventor: George L. Reynolds, Cambridge, Ill.

[73] Assignee: The United States of America as represented by the Secretary of the Army, Washington, D.C.

[21] Appl. No.: 43,766

[22] Filed: May 30, 1979

[51] Int. Cl.[3] ..... F41F 19/10

[52] U.S. Cl. ..... 89/44 R; 89/1 K; 185/37

[58] Field of Search ..... 42/5; 89/1 K, 42 R, 89/44 R; 185/37, 39; 124/16, 25, 26, 27, 28, 29, 37, 66, 67, 68; 267/69, 70, 71, 73, 74

[56] References Cited

U.S. PATENT DOCUMENTS 3,477,419 11/1969 Caetano ..... 124/27

*Primary Examiner*—Stephen C. Bentley

*Attorney, Agent, or Firm*—Nathan Edelberg; Robert P. Gibson; A. Victor Erkkila

[57] ABSTRACT

The invention is an improved apparatus for charging a weapon-type mechanism while applying only approximately one-half the force required to move the mechanism forward. The apparatus consists of a charger assembly having a spring which is extended by an initial force applied to the charger assembly in a rearward direction and to a position where the charger assembly is latched to the barrel assembly of the weapon-type mechanism. At this position, a compression spring in the barrel assembly is fully extended.

The barrel assembly and the charger assembly latched to it are then moved forward to compress the spring in the barrel assembly. As the forward position of the combined barrel assembly and charger assembly is reached, the spring in the barrel assembly being essentially fully compressed, the barrel assembly is latched in place at this position as the charger assembly is delatched from the barrel assembly. The force to compress the spring in the barrel assembly is approximately twice the aforesaid initial force applied to the charger assembly.

16 Claims, 4 Drawing Figures

DOUBLE ACTION CHARGING MECHANISM

GOVERNMENTAL INTEREST

The invention described herein may be manufactured, used and licensed by or for the Government for Governmental purposes without payment to me of any royalty thereon.

BACKGROUND AND SUMMARY OF THE INVENTION

The invention relates to charging mechanisms, and particularly to charging mechanisms for weapons. Specifically, the invention relates to a charging mechanism that requires only approximately one-half the effort to operate it as charging mechanisms required in the prior art.

A need has existed for a charging mechanism that requires less manual force to charge a device, such as a weapon with a forward moving barrel, and which have relatively heavy drive springs to compress during the charging.

In the prior art various methods were used to provide a mechanical advantage for the operator, such as a gear system, a cable and pulley system, a chain and pulley system, or other similar arrangements. While these systems are satisfactory, the problem is that the charger mechanism must be operated through relatively long distances. Such long distances are particularly undesirable in the case of weapons mounted in or on vehicles. The present invention overcomes such problems.

While the present invention is shown as related to charging mechanisms for weapons systems, it is to be understood that the double action charging mechanism may be applied to other systems as well where a charging mechanism is used.

In addition to reducing the manual effort required for charging a weapon, the present invention also reduced the travel or linear displacement involved in operating the charging mechanism. For example, a weapon mechanism might require a force of thirty pounds and a travel of twelve inches to activate it to the charged position. In the prior art the charging mechanism would be moved twenty-four inches. With the present invention, the charging mechanism would be moved only twelve inches and with a force of fifteen pounds.

It is therefore, an object of the invention to provide a charging mechanism that has a double action.

It is another object of the invention to provide a charging mechanism that can be used for both weapons and non-weapon mechanisms.

It is still another object of the invention to provide a charging mechanism that requires only a linear displacement equal to the linear displacement of the operating mechanism which it services.

It is yet another object of the invention to provide a charging mechanism that requires an operating force of only one-half of the force required to set the operating mechanism which it services.

Further objects and advantages of the invention will become more apparent in the light of the following description of the preferred embodiments.

DESCRIPTION OF THE PREFERRED EMBODIMENTS

Figure 1:
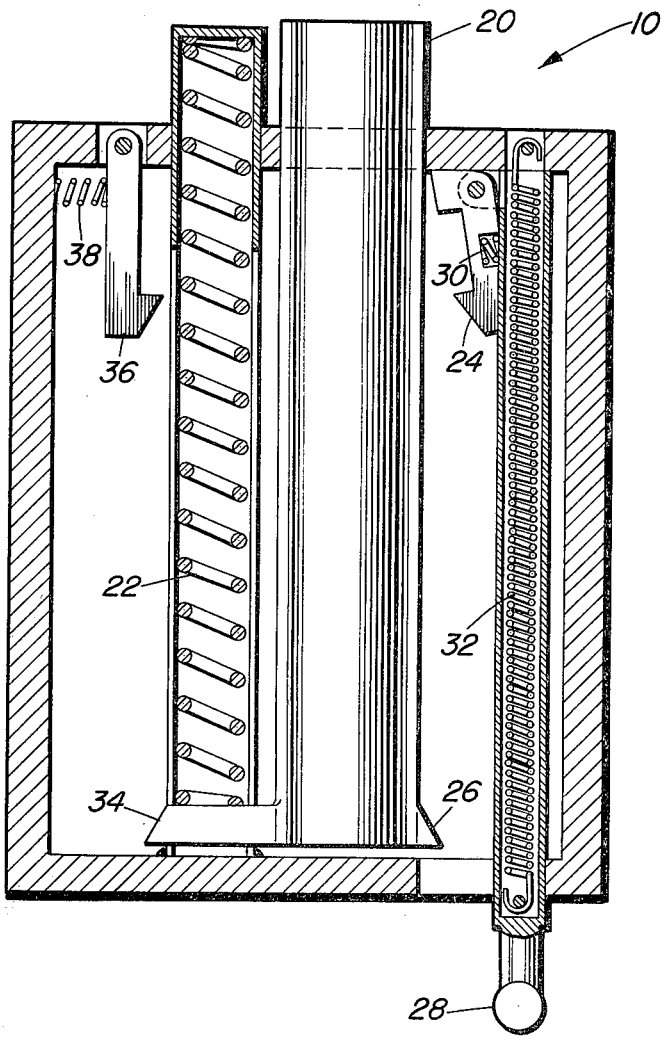
FIG. 1 is a cross sectional view of a double action charging mechanism in association with a weapon barrel assembly before charging.

Referring to the drawings and particularly to FIGS. 1, 2, 3, and 4, a double action charging mechanism is shown at 10 in various positions of a charging sequence.

The actual complete structure and operation of a weapons system is not included in this disclosure or in the drawings, as only the force means of the charging mechanism is involved. Neither are any magazines or belt feeds shown for carrying the actual charge to the system.

The double action charging mechanism 10 consists of a charging latch 24, a charging handle 28, a charging latch spring 30, and a charging tension spring 32. The double action charging mechanism 10 operates in conjunction with certain elements of a weapons system which are associated with the barrel 20 of the weapons system.

The elements of a weapons system that are associated with the barrel 20 of the weapons system are the barrel compression spring 22, the barrel charging lug 26, the barrel cocking lug 34, the cocking latch 36, and the cocking latch spring 38.

Referring now to FIG. 1, the double action charging mechanism 10 is shown in the initial position when the weapons system is not loaded and the barrel 20 is in the unloaded position.

It is to be noted, as hereinbefore mentioned, that the mechanisms of the weapons system that conveys the charge to the barrel, such as a magazine or belt, are not shown for purposes of clarity. Neither are any trigger or firing mechanisms of the weapons system shown. The aforementioned mechanisms are not of the present invention or involved in the operation of the double action charging mechanism 10, although the conveying of a charge to a position for firing takes place as the double action charging mechanism completes its cycle.

It is to be noted that although the description of a double action charging mechanism 10 disclosed here is related to a weapons system, the double action charging mechanism 10 may be used in any system requiring a similar action for loading a charge into the system.

For simplicity and clarity the double action charging mechanism 10 and the aforementioned elements of the weapons system that are associated with the barrel 20, are shown within a typical housing enclosure, not numbered.

Figure 2:
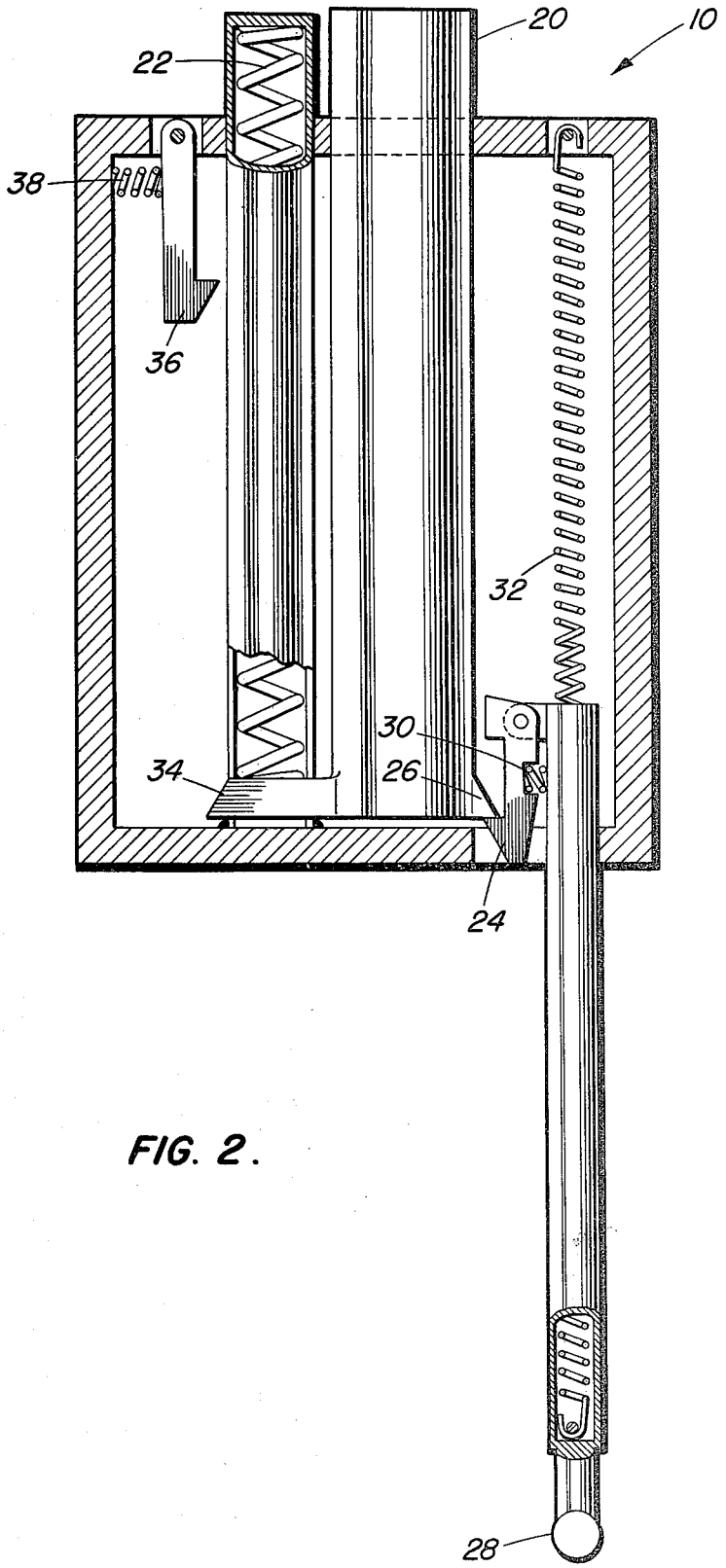
FIG. 2 is a cross sectional view of a double action charging mechanism at the first position in a charging sequence.

To begin the operation of the double action charging mechanism 10, refer to FIGS. 1 and 2. The charging handle 28 is pulled to the rear of the weapon, in FIGS. 1 and 2 this is downward as shown.

As the charging handle moves toward the rear of the weapon, the charging tension spring 32, which has been in a closed or relieved mode, is stretched and put into an open or tension mode.

As soon as the charging handle 28 moves a short distance the charging latch 24, which is affixed to the case around the charging tension spring 32, moves away from its interface with the aforementioned housing enclosure. As it does, the charging latch spring 30, which has been compressed in its pocket in the charging latch 24, opens or expands to move the charging latch 24 in a small arc in a clockwise direction around the pin of the connection to the case of the charging tension spring 32. This puts the charging latch 24 in a position for its subsequent latching function.

The charging handle 28 is pulled rearward until the sloped face of the charging latch 24 interfaces with the sloped face of the barrel charging lug 26. As the charging handle 28 is pulled further rearward, the interfacing of the sloped face of the charging latch 24 and the sloped face of the barrel charging lug 26 slide upon each other in a cam-type action. This sliding action moves the charging latch 24 in a counter-clockwise arc and compresses the charging latch spring 30 until the tip of the sloped face of the charging latch 24 slips over the tip of the barrel charging lug 26. The compressed charging latch spring 30 now expands to move the charging latch 24 in clockwise arc to hook the latching face of the charging latch 24 in back of the barrel charging lug 26. The charging latch 24 is now in communication with the barrel 20 by way of the barrel charging lug 26.

The force required on the charging handle 28 to extend the charging tension spring 32 will vary with the size of the spring involved. However, in the present invention, the force required to extend the charging tension spring 32 is essentially one-half the force required to compress the barrel compression spring 22.

Figure 3:
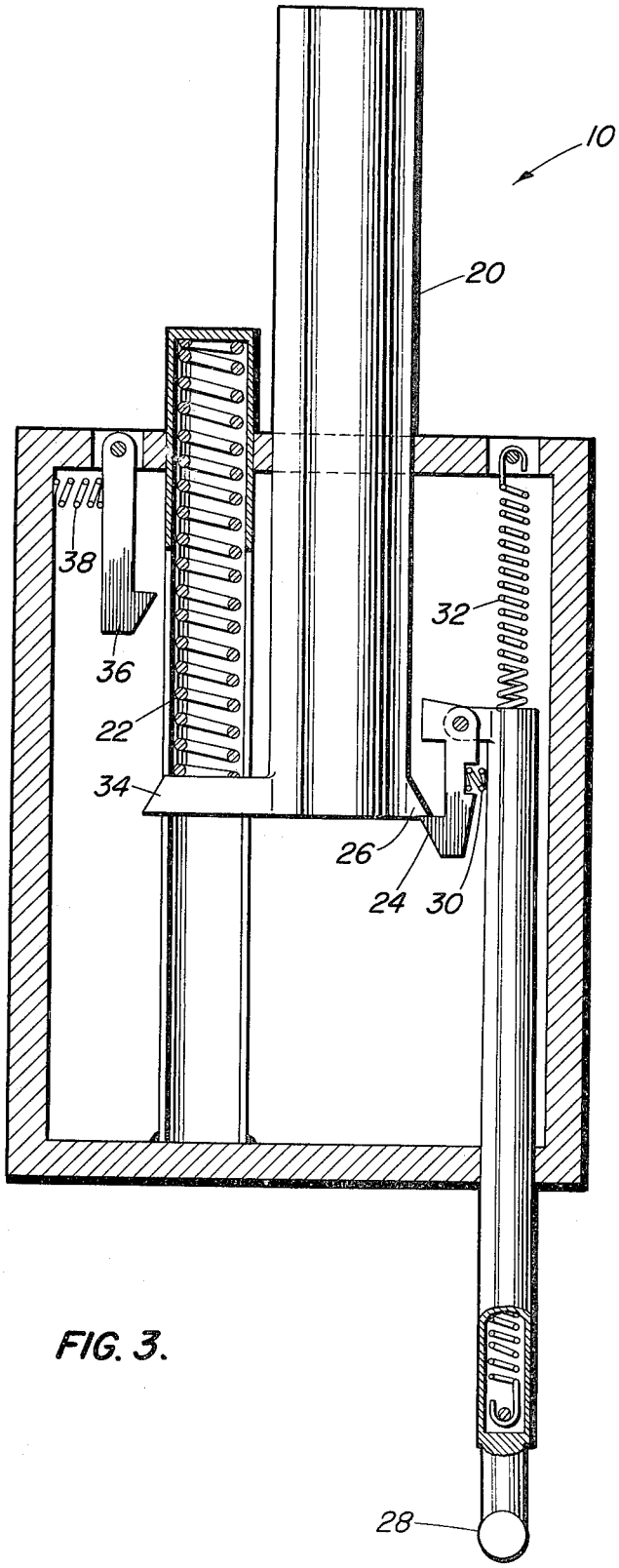
FIG. 3 is a cross sectional view of a double action charging mechanism midway in the charging sequence.
Figure 4:
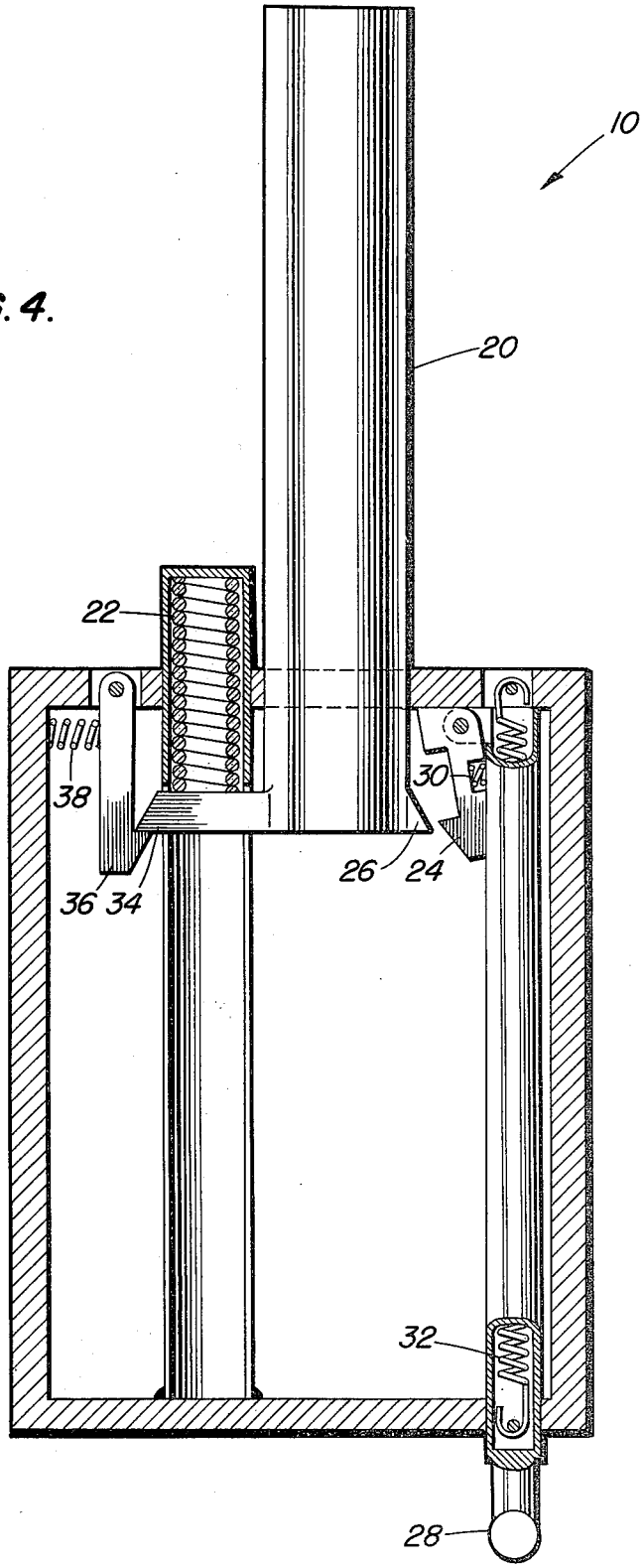
FIG. 4 is a cross sectional view of a double action charging mechanism at the completion of the charging sequence.

For the remainder of the charging action for the weapons system refer to FIGS. 2, 3, and 4.

With the double action charging mechanism 10 in communication with the barrel 20 through the barrel charging lug 26, as hereinbefore described and as shown in FIG. 2, charging handle 28 is now moved forward in relation to the weapons system. The movement forward of charging handle 28 is shown at an intermediate point of movement forward in FIG. 3.

The movement forward of charging handle 28 moves the entire double action charging mechanism 10 forward, as can be seen in FIG. 3. As this forward movement takes place, the extended charging tension spring 32 closes as the barrel compression spring 22 is compressed. As the charging tension spring 32 closes it assists in compressing the barrel compression spring 22.

As the force required to extend the charging tension spring 32 is essentially one-half the force required to compress the barrel compression spring 22, the closing charging tension spring 32 will now provide essentially one-half of the force that is compressing the barrel compression spring 22. The other half of the force required to compress the barrel compression spring 22 will be supplied by the operator pushing the charging handle 28 forward. Thus, a double action takes place as the weapons system is charged. An action to place the charging tension spring 32 in tension and then an action utilizing that tension to partially operate the charging mechanism.

As the movement of the charging handle 28 is moved forward further, as shown in FIG. 3 and FIG. 4, a double action takes place as the double action charging mechanism 10 in FIG. 4 reaches the original position from which it started in FIG. 1. In that double action one action takes place at the charging latch 24 and one action takes place at the cocking latch 36.

As the barrel 20, being moved forward by the double action charging mechanism 10, nears its most forward position, the tip of the tapered end of the charging latch 24 interfaces with the housing enclosure. As the movement forward continues, the tip of the tapered end slides along the inside face of the housing enclosure in a cam-type action which rotates the charging latch 24 in an arc in a counter-clockwise direction until the latching face of the charging latch 24 slides out from under the back of the barrel charging lug 26. As this cam-type action takes place it compresses the charging latch spring 30 within its pocket in the charging latch 24.

Concurrently with the aforementioned action at the charging latch 24, a companion action takes place at the cocking latch 36. As the barrel 20, being moved forward by the double action charging mechanism 10, nears its most forward position, the sloped face of the barrel cocking lug 34 interfaces with the sloped face of the cocking latch 36. As the barrel 20 continues to move forward the sloped face of the cocking latch 36 slides along the sloped face of the barrel cocking lug 34 in a cam-like action. This sliding action rotates the cocking latch 36 in a clockwise arc and compresses the cocking latch spring 38 until the tip of the cocking latch 36 slips over the tip of the barrel cocking lug 34. The compressed cocking latch spring 38 now expands to rotate the cocking latch 36 in an counter-clockwise arc to hook the latching face of the cocking latch 36 in back of the barrel cocking lug 34 and serve as a retaining means. The cocking latch 34 is now in communication with the barrel 20 by way of the barrel cocking lug 34.

To assure maintenance of the 2 to 1 force ratio between the barrel compression spring 22 and the charging tension spring 32, the latching action at the cocking latch 36 takes place momentarily just before the charging latch 24 releases. Thereafter the compressed barrel compression spring 22 forces the barrel cocking lug 34 against the cocking latch 36 which arrests the barrel 20 in the forward position. In the case of a weapon mechanism it is now fully cocked.

It is to be noted that means for affixing the charging spring 32 to the case and charging handle 28 and anchoring the charging spring 32 to the housing enclosure may be by any suitable means. Likewise, means for pivoting the charging latch 24 and the cocking latch 36 may be by any suitable method.

As can be readily understood from the foregoing description of the invention, the present structure can be configured in different modes to provide the ability to perform a charging mission with a reduction in the manual effort to do so.

Accordingly, modifications and variations to which the invention is susceptible may be practiced without departing from the scope and intent of the appended claims.

I claim:

1. A double action charging mechanism for a system to be charged having a chamber and a housing means, comprising:

a tensioning means having a first end and a second end, said first end being suitably anchored to said housing means, said tensioning means having a case therearound;

a handle means affixed to one end of said case, said second end of said tensioning means being attached inside said case at end where said handle means is affixed;

a latching means, said latching means being affixed to distal end of said case from said handle means, said latching means being pivoted at one end so as to be capable of rotation through an arc; and a spring means affixed between said latching means and said case for moving said latching means through said arc.

2. The double action charging mechanism as recited in claim 1, and additionally a first lug means affixed to said chamber to engage said latching means.

3. The double action charging mechanism as recited in claim 2, and additionally a retainer means affixed to said housing means, a second lug means affixed to said chamber, said retainer means engaging said second lug means to hold said chamber in position when said latching means is disconnected from said first lug means.

4. The double action charging mechanism recited in claim 2, wherein said latching means has a first end and a second end, said first end having a hook-like configuration for engaging said first lug means, said second end having a sloped face to interface with said housing means in a cam-like action and thereby rotating said latching means in an arc about said pivoted end.

5. The double action charging mechanism recited in claim 3, and additionally a compression spring means associated with said chamber and mounted on said second lug means.

6. The double action charging mechanism recited in claim 4, and additionally a compression spring means affixed between said latching means and said case.

7. The double action charging mechanism recited in claim 3, and additionally a compression spring means affixed between said retainer means and said housing means.

8. The double action charging mechanism recited in claim 5, said tensioning means having a strength of approximately one-half the compressive strength of said compression spring means mounted on said second lug means.

9. A double action charging mechanism for a weapons system having a barrel and a housing means, comprising:

a tensioning means having a first end and a second end, said first end being suitably anchored to said housing means, said tensioning means having a case therearound;

a handle means affixed to one end of said case, said second end of said tensioning means being suitably attached inside said case at end where said handle means is affixed;

a latching means, said latching means being affixed to distal end of said case from said handle means, said latching means being pivoted at one end so as to be capable of rotation through an arc; and a spring means affixed between said latching means and said case.

10. The double action charging mechanism as recited in claim 9, and additionally a first lug means affixed to said barrel to engage said latching means.

11. The double action charging mechanism as recited in claim 10, and additionally a retainer means affixed to said housing means, second lug means affixed to said barrel, said retainer means engaging said second lug means to hold said barrel in position when said latching means is disconnected from said first lug means.

12. The double action charging mechanism recited in claim 10, wherein said latching means has a first end and a second end, said first end having a hook-like configuration for engaging said first lug means, said second end having a sloped face to interface with said housing means in a cam-like action and thereby rotating said latching means in an arc about said pivoted end.

13. The double action charging mechanism recited in claim 11, and additionally a compression spring means associated with said barrel and mounted on said second lug means.

14. The double action charging mechanism recited in claim 12, and additionally a compression spring means affixed between said latching means and said case.

15. The double action charging mechanism recited in claim 11, and additionally a compression spring means affixed between said retainer means and said housing means.

16. The double action charging mechanism recited in claim 13, said tensioning means having a strength of approximately one-half the compression strength of said compression spring means mounted on said second lug means.

* * * * *